US007307204B2

(12) United States Patent
Ito

(10) Patent No.: US 7,307,204 B2
(45) Date of Patent: Dec. 11, 2007

(54) DRUM WITH HEAD ADJUSTING DEVICE

(75) Inventor: Fusamitsu Ito, Aichi (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 129 days.

(21) Appl. No.: 11/042,943

(22) Filed: Jan. 24, 2005

(65) Prior Publication Data

US 2006/0016319 A1 Jan. 26, 2006

(30) Foreign Application Priority Data

Jul. 20, 2004 (JP) ..... 2004-211724

(51) Int. Cl.
*G10D 13/02* (2006.01)

(52) U.S. Cl. ..... 84/411 R; 411/187

(58) Field of Classification Search ..... 84/411 R, 84/413; 411/187, 369, 371.1
See application file for complete search history.

(56) References Cited

U.S. PATENT DOCUMENTS 4,875,818 A * 10/1989 Reinwall ..... 411/369
5,193,960 A * 3/1993 Fukushima et al. ..... 411/542
5,208,412 A * 5/1993 Hoshino ..... 84/413
6,048,150 A * 4/2000 Clarke ..... 411/187
6,231,286 B1 * 5/2001 Bogatz et al. ..... 411/371.1
6,686,527 B2 * 2/2004 Hagiwara ..... 84/413
6,828,495 B2 * 12/2004 Ishimatsu ..... 84/413

FOREIGN PATENT DOCUMENTS

JP 05-307383 11/1993

* cited by examiner

*Primary Examiner*—Lincoln Donovan
*Assistant Examiner*—Jianchun Qin
(74) *Attorney, Agent, or Firm*—Ostrolenk, Faber, Gerb & Soffen, LLP

(57) ABSTRACT

A drum includes a cylindrical body, a cylindrical head frame, which is fitted to the outer circumference of the body, a hoop located at the outer circumference of a head, lugs located at the outer circumference of the body, lug nuts, and lug bolts. A loosening prevention structure is located between the lower surface of the head of each lug bolt and the upper surface of the hoop. Each loosening prevention structure is formed by a washer with rubber according to a preferred embodiment. The washer with rubber is formed by an annular elastic body and a bowl-shaped cover. The elastic body is made of rubber. The cover includes a cylindrical portion, which covers the outer circumference of the elastic body. The cylindrical portion is formed to be shorter than the elastic body along the axial direction of the body.

9 Claims, 4 Drawing Sheets

Fig.6 (a) (Prior Art)
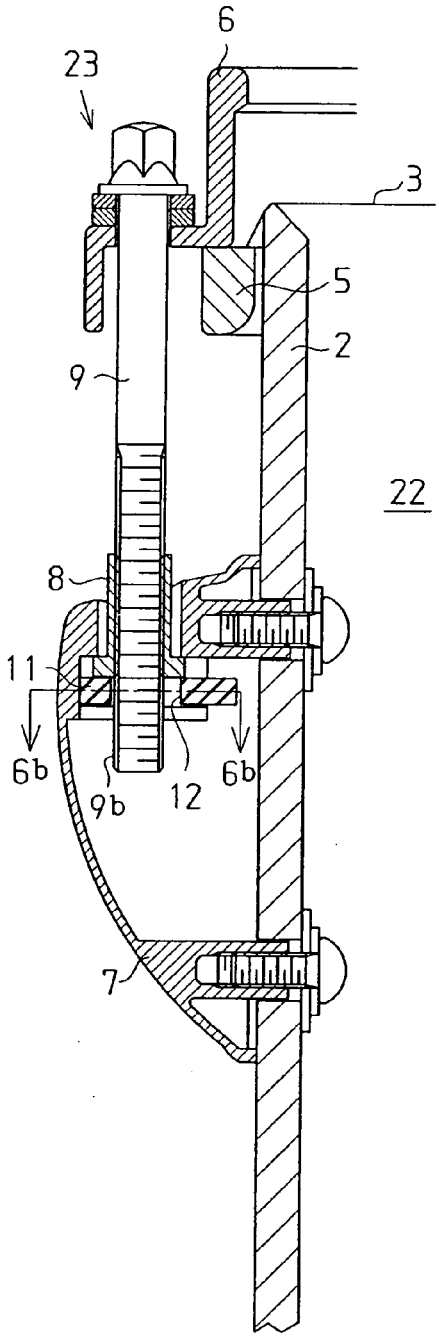
Fig.6 (b) (Prior Art)
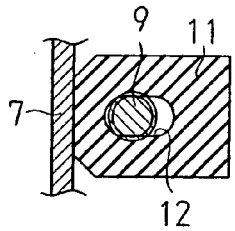

DRUM WITH HEAD ADJUSTING DEVICE

BACKGROUND OF THE INVENTION

The present invention relates to a drum with a head adjusting device.

Drums such as bass drums and snare drums include head adjusting devices located around its body for adjusting the tension of a drumhead (for example, Japanese Laid-Open Patent Publication No. 05-307383). FIG. 6(*a*) is a cross-sectional view illustrating one example of such a head adjusting device. FIG. 6(*a*) shows a head adjusting device for adjusting the tension of the upper head.

As shown in FIG. 6(*a*), a drum 22 includes a cylindrical body 2 having upper and lower openings. A disk-like upper head 3 and a lower head (not shown) are provided at the upper and lower ends of the body 2 to close the openings. An annular upper head frame 5, which can be fitted to the outer circumference of the body 2, retains the outer circumferential rim of the upper head 3. An upper hoop 6 covers the outer circumference and the top of the upper head frame 5. The lower surface of the upper hoop 6 abuts against the upper surface of the upper head frame 5. The upper hoop 6 is separate from the body 2.

A head adjusting device 23 for adjusting the tension of the upper head 3 includes a lug 7, which is secured to the periphery of the body 2, a lug nut 8, which is located at the upper end of the lug 7, and a lug bolt 9, which couples the lug nut 8 to the upper hoop 6. The lug bolt 9 is inserted through the upper hoop 6 from above the drum 22 and is threaded into the lug nut 8 at its distal end. When adjusting the tension of the upper head 3, the lug bolt 9 is selectively tightened or loosened with respect to the lug nut 8 so that the upper head frame 5 is shifted along the axial direction via the upper hoop 6.

When playing the drum 22, the lug bolt 9 might be loosened by strong vibration of the upper head 3, and the drum 22 might go out of tune. Therefore, several structures have been proposed to prevent undesirable loosening of the lug bolt 9. For example, a head adjusting device 23 has been proposed that has a thin rubber sheet 11 below the lug nut 8. An oval hole 12 is formed in the rubber sheet 11 to permit the distal end of the lug bolt 9 to be inserted therethrough (see FIG. 6(*b*)). The lug bolt 9 is prevented from being undesirably loosened by press-fitting the rubber sheet 11 to the root of a threaded portion 9*b* formed on the periphery of the distal end of the lug bolt 9.

However, since the rubber sheet 11 has high elasticity and flexibility, although the rubber sheet 11 is press-fitted to the root of the threaded portion 9*b* of the lug bolt 9, the vibration of the upper head 3 might not be suppressed sufficiently. Furthermore, when continuously playing the drum 22 for a long period, there is a high possibility that the lug bolt 9 will be gradually loosened regardless of the player's intention.

Another structure (not shown) for preventing loosening of the lug bolt 9 has been proposed that uses an annular member made of nylon instead of the rubber sheet 11. A bore, which has a slightly smaller diameter than the outer diameter of the lug bolt 9, is formed in the annular member. Since the lug bolt 9 is threaded into the bore, great frictional force is generated between the annular member and the threaded portion 9*b* of the lug bolt 9. As a result, the lug bolt 9 is prevented from undesirably rotating by shocks and vibration. On this point, the structure prevents the lug bolt 9 from being loosened even if the drum 22 is played for a long time, more reliably than the case where the rubber sheet 11 is provided. However, in this case, the torque required for tightening the lug bolt 9 is increased and a special tuning key must be used. As a result, the tuning process becomes troublesome. Also, the annular member will deform after a long period of usage and the frictional force will be reduced. This might gradually cause undesirable loosening between the annular member and the lug bolt 9.

As other structure for preventing undesirable loosening, a structure in which another lock nut is provided on the lug bolt 9 above the lug nut 8 to doubly couple the lug nut 8 and a structure in which a thin plate-like member made of plastic is provided between the head of the lug bolt 9 and the upper hoop 6 to prevent unintentional rotation have been proposed. However, in these cases, the lock nut must be loosened or the thin plate-like member must be removed every time the drum 22 is tuned. Therefore, the tuning process is complicated.

SUMMARY OF THE INVENTION

Accordingly, it is an objective of the present invention to provide a drum that facilitates a tuning process and easily prevents undesirable loosening of a coupling bolt caused by vibration during a performance.

To achieve the foregoing and other objectives and in accordance with the purpose of the present invention, a drum including a cylindrical body, a head, a cylindrical head frame, a hoop, a plurality of fasteners, a plurality of coupling bots, and a plurality of loosening prevention structures is provided. The cylindrical body has an opening, an outer circumference, and axial direction. The head covers the opening of the body. The head includes a rim and an outer circumference. The cylindrical head frame is fitted to the outer circumference of the body. The head frame retains the rim of the head and is movable along the axial direction of the body. The hoop is provided at the outer circumference of the head. The hoop abuts against the head frame to press the head frame along the axial direction of the body so that tension is applied to the head. The hoop includes a plurality of mounting holes. The fasteners are located at the outer circumference of the body. Each fastener is located opposite to the hoop with the head frame located in between, and each fastener includes a nut. The coupling bolts extend along the axial direction of the body. Each coupling bolt includes a head, with the head located opposite to the nut of one of the fasteners with the hoop located in between. Each coupling bolt is inserted in one of the mounting holes and threaded to said nut so that the hoop is coupled to the fastener. Each loosening prevention structure is located between the head of one of the coupling bolts and the hoop, and includes an annular elastic body through which said one of the coupling bolts is inserted and a deformation restricting member, which restricts deformation of the elastic body along said axial direction.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 6(*a*) is a partial cross-sectional view illustrating a prior art drum; and FIG. 6(*b*) is a cross-sectional view of the drum taken along line 6*b*-6*b* of FIG. 6(*a*).

DETAILED DESCRIPTION OF THE PREFERRED EMBODIMENTS

Figure 1:
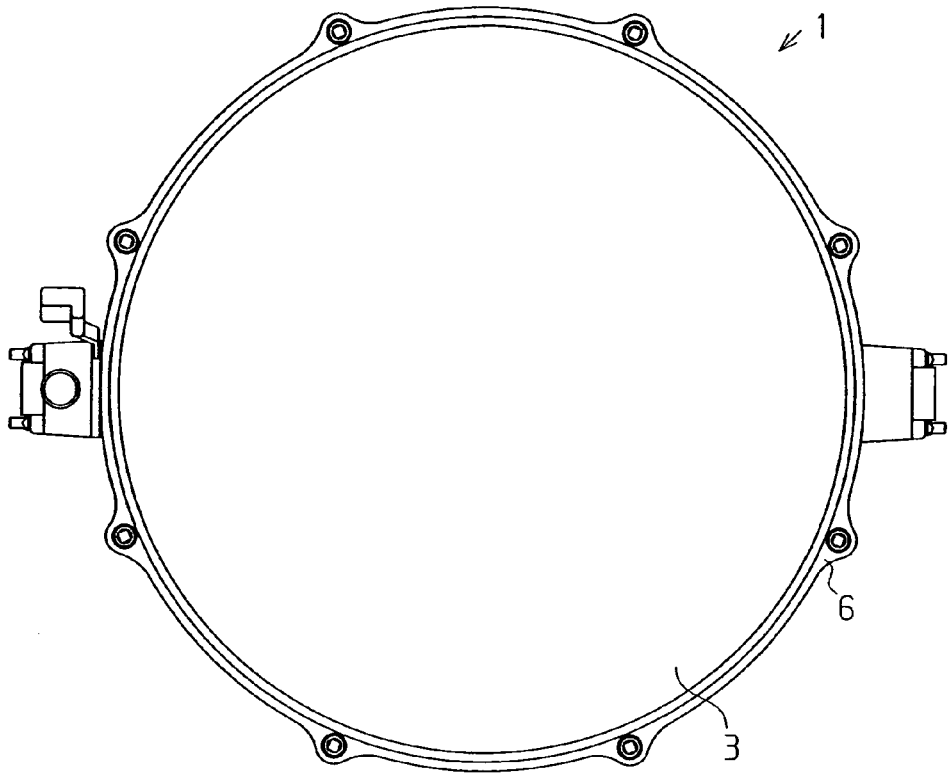
FIG. 1 is a plan view illustrating a drum according to a preferred embodiment.

A drum 1 according to one embodiment of the present invention will now be described. Like or the same reference numerals are given to those components that are like or the same as the corresponding components of the prior art shown in FIGS. 6(*a*) and 6(*b*).

Figure 2:
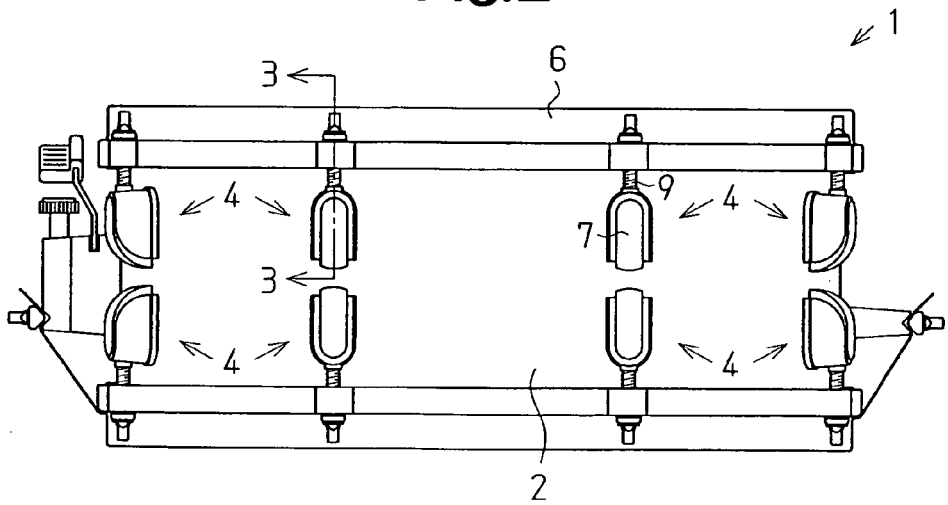
FIG. 2 is a side view illustrating the drum according to the preferred embodiment.

FIG. 1 is a plan view illustrating the drum 1 according to the preferred embodiment. FIG. 2 is a side view of the drum 1. As shown in FIGS. 1 and 2, the drum 1 includes a cylindrical body 2 having upper and lower openings. A disk-like upper head 3 and a lower head (not shown) are provided at the upper and lower ends of the body 2 to close the openings. Head adjusting devices 4 for adjusting the tension of the upper head 3 and the lower head are provided at the outer circumference of the body 2 at equal angular intervals. The drum 1 of the preferred embodiment includes eight head adjusting devices 4 at each of the upper and lower portions of the body 2.

Figure 3:
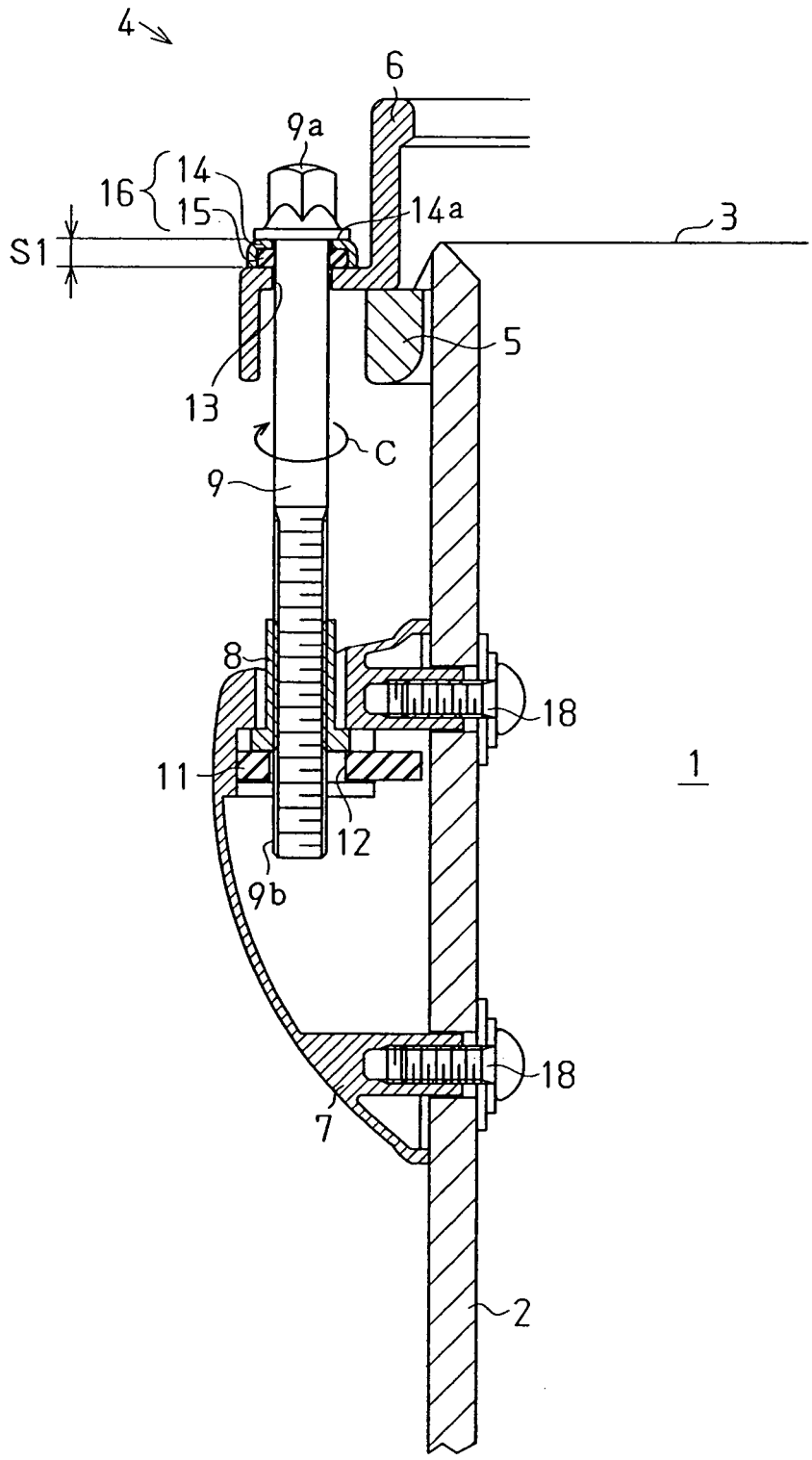
FIG. 3 is a partial cross-sectional view of the drum taken along line 3-3 of FIG. 2.

FIG. 3 is a partial cross-sectional view of the drum 1 taken along line 3-3 of FIG. 2. One of the head adjusting devices 4 for adjusting the tension of the upper head 3 is enlarged in FIG. 3. Furthermore, FIG. 3 shows the drum 1 after the tension of the upper head 3 has been tuned. As shown in FIG. 3, an annular upper head frame 5, which can be fitted to the outer circumference of the body 2, retains the outer circumferential rim of the upper head 3. An upper hoop 6 covers the outer circumference and the top of the upper head frame 5. The lower surface of the upper hoop 6 abuts against the upper surface of the upper head frame 5. The upper hoop 6 is separate from the body 2.

Each head adjusting device 4 for adjusting the tension of the upper head 3 includes a fastener, which is a lug 7 in this embodiment, a lug nut 8, and a lug bolt 9. The lug 7 is secured to the outer circumference of the body 2. The lug nut 8 is located at the upper end of the lug 7. The lug bolt 9 couples the lug nut 8 to the upper hoop 6. The lug 7 is secured to the body 2 with two screws 18 inserted from the inside of the body 2 with one side of the lug 7 in close contact with the outer circumferential surface of the body 2. The lower portion of the lug nut 8 is located inside the lug 7 and the upper end of the lug nut 8 projects upward from the upper surface of the lug 7. A rubber sheet 11 is located below the lug nut 8. The rubber sheet 11 contacts the lower surface of the lug nut 8 and prevents the lug nut 8 from undesirably rotating while screwing the lug bolt 9 into the lug nut 8. An oval hole 12 (see FIG. 6(*b*)) is formed in the rubber sheet 11.

The lug bolt 9 is inserted into a mounting hole 13 formed in the upper hoop 6 from above the drum 1. A threaded portion 9*b* is formed at the distal end of the lug bolt 9 for threadably engaging the lug nut 8. The threaded portion 9*b* is inserted through the lug nut 8 and the hole 12 of the rubber sheet 11. At this time, the rubber sheet 11 is press-fitted to the root of the threaded portion 9*b* to prevent undesirable rotation of the lug bolt 9.

A loosening prevention structure is located between a head 9*a* of the lug bolt 9 and the upper hoop 6. The loosening prevention structure is constituted by a washer 16 with rubber inserted between the lower surface of the head 9*a*, which is for rotating the lug bolt 9, and the upper surface of the upper hoop 6. The washer 16 with rubber includes an annular elastic body 15 made of rubber and a bowl-shaped cover 14, which covers the elastic body 15. As show in FIG. 4, the cover 14 includes an annular portion 14*a* and a cylindrical portion 14*b*. The annular portion 14*a* has, at its center, an insertion hole 14*c* for permitting the lug bolt 9 to be inserted through. The cylindrical portion 14*b* extends downward from the outer circumferential rim of the annular portion 14*a*. The cylindrical portion 14*b* is formed cylindrically to cover the outer circumference of the elastic body 15.

Figure 4:
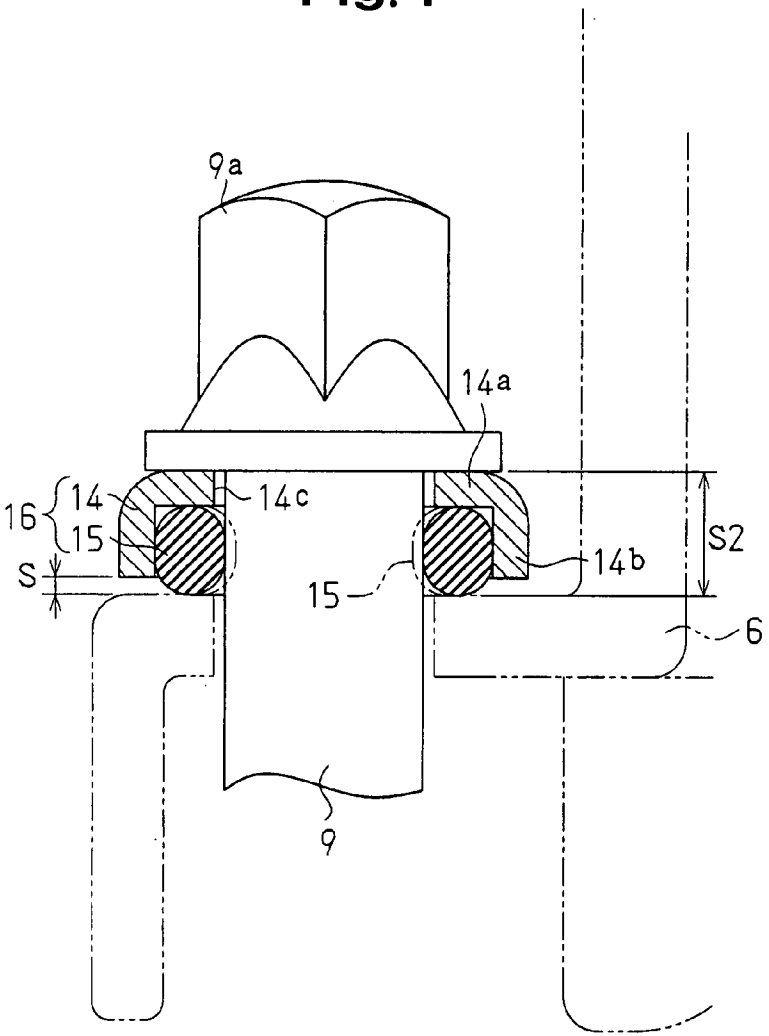
FIG. 4 is a side view illustrating the vicinity of the head of the lug bolt according to the preferred embodiment.

FIG. 4 is an enlarged side view illustrating the vicinity of the head 9*a* of the lug bolt 9 and the washer 16 with rubber. Unlike FIG. 3, which shows the state after the tension of the upper head 3 is tuned up, FIG. 4 shows the state before tuning up of the upper head 3. That is, the elastic body 15 of the washer 16 with rubber shown in FIG. 4 is not compressed along the axial direction of the body 2. As shown by a chain double-dashed line in FIG. 4, according to the preferred embodiment, the inner diameter of the elastic body 15 before being attached to the lug bolt 9 is slightly smaller than the outer diameter of the lug bolt 9. The elastic body 15 after being attached to the lug bolt 9 elastically deforms along the outer circumferential surface of the lug bolt 9. Therefore, the inner circumferential surface of the elastic body 15 closely contacts the outer circumferential surface of the lug bolt 9.

The inner diameter of the insertion hole 14*c* of the annular portion 14*a* is slightly greater than the outer diameter of the lug bolt 9. Since the axial thickness of the elastic body 15 is greater than the height of the cylindrical portion 14*b*, the lower end of the elastic body 15 projects downward from the lower end of the cylindrical portion 14*b*. With this structure, when the washer 16 with rubber is attached to the lug bolt 9, the elastic body 15 applies inward force to the lug bolt 9 to eliminate elastic deformation so that its shape is restored to the state before being attached to the lug bolt 9. Therefore, the washer 16 with rubber is secured to the lug bolt 9. Therefore, when the lug bolt 9 is detached from the drum 1 when exchanging the upper head 3, the washer 16 with rubber is prevented from falling off the lug bolt 9.

As shown in FIG. 4, when the elastic body 15 is not compressed along the axial direction, a space S is formed between the lower end of the cylindrical portion 14*b* and the upper surface of the upper hoop 6. The space S corresponds to the length by which the elastic body 15 is axially compressed by screwing the lug bolt 9 into the lug nut 8, that is, the space S corresponds to the deformation length of the elastic body 15 that is deformed along the axial direction of the body 2. As shown in FIG. 3, when the lug bolt 9 is properly tightened relative to the lug nut 8, the elastic body 15 is compressed by the length corresponding to the space S between the lower surface of the head 9*a* of the lug bolt 9 and the upper surface of the upper hoop 6. Thus, the lower end of the cylindrical portion 14*b* abuts against the upper surface of the upper hoop 6 and the space S is eliminated. Therefore, the annular portion 14*a* abuts against the lower surface of the head 9*a* of the lug bolt 9, and the upper surface of the upper hoop 6 abuts against the lower surface of the cylindrical portion 14*b* and the elastic body 15.

In the state shown in FIG. 3, the compressed elastic body 15 urges the annular portion 14*a* and the upper hoop 6 in a direction to separate from each other. A deformation restricting member, which restricts deformation of the elastic body 15, is constituted by the cylindrical portion 14*b* of the cover 14. That is, the deformation restricting member restricts the axial deformation length of the elastic body 15 such that the space S1 between the lower surface of the head 9*a* and the upper surface of the upper hoop 6 is equal to the height of the cylindrical portion 14*b* by the abutment between the upper end of the cover 14 (the upper end of the cylindrical portion 14*b*) and the lower surface of the head 9*a* of the lug bolt 9 and the abutment between the lower end of the cylindrical portion 14*b* and the upper surface of the upper hoop 6. A stopper of the present invention comprises the inner surface of the cylindrical portion 14*b*, which covers the outer circumference of the elastic body 15. The stopper prevents the elastic body 15 from being compressed outward. The loosening prevention structure of the present invention comprises the washer 16 with rubber. The loosening prevention structure suppresses undesirable loosening of the lug bolt 9 caused by vibration during a performance. According to the preferred embodiment, the outer diameter of the lug bolt 9 except the head 9*a* is 5 mm, the outer diameter of the cover 14 is 12 mm, and the height of the cylindrical portion 14*b* is 3 mm. In this case, the space S shown in FIG. 4 is preferably about 1 mm.

When tuning up the drum 1, the head 9*a* of the lug bolt 9 is rotated to adjust the length of the lug bolt 9 threaded into the lug nut 8. The tension of the upper head 3 is adjusted accordingly. More specifically, when tuning the upper head 3 to increase the tension, the head 9*a* of the lug bolt 9 is rotated clockwise C from the state shown in FIG. 3 so that the lug bolt 9 is threaded into the lug nut 8. The lower surface of the head 9*a* of the lug bolt 9 lowers in accordance with the rotation amount thereby pressing the upper hoop 6 downward. As a result, the upper head frame 5 moves downward along the axial direction of the drum 1. When the upper head frame 5 moves downward, the outer circumferential rim of the upper head 3 is pulled downward. Therefore, the upper head 3 is adjusted by stretching thereof. When tuning the drum 1 to loosen the upper head 3, the head 9*a* of the lug bolt 9 is rotated counterclockwise. As a result, the upper head 3 is loosened by operation opposite to the above.

Prevention of loosening of the lug bolt 9 due to vibration during a performance will now be described in relation to the washer 16 with rubber. Vibration caused during a performance is described below. In FIG. 3, when the upper head 3 is beaten during a performance, the upper head 3 receives force in a stretching direction. Therefore, an upward force instantaneously acts on the upper head frame 5 along the axial direction of the drum 1. The upward force moves the lug bolt 9 and the washer 16 with rubber upward via the upper hoop 6. After that, the upper head 3 is instantaneously loosened as beating force is released. In this case, the upper head frame 5 and the upper hoop 6 move downward and are restored to the original position (the position shown in FIG. 3 before the upper head 3 is beaten) by movement opposite to the above. Accordingly, the lug bolt 9 and the washer 16 with rubber move downward.

However, since the lug bolt 9 and the washer 16 with rubber move down slightly later than the upper head frame 5 due to inertia, the space S1 between the lower surface of the head 9*a* of the lug bolt 9 and the upper hoop 6 is instantaneously widened. The space S1 might instantaneously become wider than the space S2 between the lower surface of the head 9*a* of the lug bolt 9 and the upper hoop 6 in the state shown in FIG. 4. As described above, the restoring force of the compressed elastic body 15 constantly acts upward and downward between the lower surface of the annular portion 14*a* and the upper surface of the upper hoop 6. Therefore, when the space S1 widens, the elastic body 15 deforms to be widened upward and downward accordingly. Thus, the abutment between the upper surface of the annular portion 14*a* and the lower surface of the head 9*a* of the lug bolt 9 and the abutment between the lower end of the elastic body 15 and the upper surface of the upper hoop 6 are maintained. After that, the lug bolt 9 and the cover 14 lowers to be restored to the original position (the state shown in FIG. 3). Accordingly, the elastic body 15 is compressed along the axial direction to be restored to the state shown in FIG. 3.

As described above, when the lug bolt 9 moves along the axial direction with respect to the upper hoop 6 by vibration, since the elastic body 15 is compressed along the axial direction by the length corresponding to the space S in advance, the elastic body 15 keeps applying force to the lower surface of the head 9*a* of the lug bolt 9 and the upper surface of the upper hoop 6. Therefore, since the vibration caused by playing the drum 1 is absorbed by the elastic body 15, a gap is not formed between the lower surface of the head 9*a* of the lug bolt 9 and the upper surface of the annular portion 14*a* and between the lower end of the elastic body 15 and the upper surface of the upper hoop 6. Since the lug bolt 9 is prevented from undesirably rotating and loosening of the lug bolt 9 is suppressed, the drum 1 does not go out of tune during a performance. The elastic body 15 according to the preferred embodiment does not deform excessively since the deformation restricting member, which is the cylindrical portion 14*b*, keeps the length of the elastic body 15 compressed along the axial direction constant (that is, the length corresponding to the space S). As a result, the elastic body 15 can exert constant force for a long period.

Also, the elastic body 15 according to the preferred embodiment has an inner diameter that is slightly smaller than the outer diameter of the lug bolt 9 and is suppressed from being deformed outward by the inner surface of the cylindrical portion 14*b*. Therefore, the elastic body 15 always tightens the outer circumferential surface of the lug bolt 9. Therefore, strong frictional force acts between the elastic body 15 and the lug bolt 9, and the lug bolt 9 is further prevented from being loosened.

When screwing the lug bolt 9 of the preferred embodiment into the lug nut 8, torque required for rotating the lug bolt 9 is small until the lower end of the elastic body 15 abuts against the upper surface of the upper hoop 6. Therefore, the lug bolt 9 can be rotated by hand without using a special tuning key. The head adjusting devices 4 for adjusting the tension of the lower head each employ the loosening prevention structure that is the same as the head adjusting devices 4 for adjusting the tension of the upper head 3.

The preferred embodiment has the following advantages.

(1) The washer 16 with rubber, which includes the elastic body 15 and the cover 14, is inserted between the head 9*a* of the lug bolt 9 and the upper hoop 6. The elastic body 15 deforms to absorb vibration caused by playing the drum 1. Therefore, a gap is not formed between the head 9*a* of the lug bolt 9 and the cover 14 and between the elastic body 15 and the upper hoop 6. This prevents the lug bolt 9 from undesirably rotating and suppresses loosening of the lug bolt 9. As a result, the drum 1 is prevented from going out of tune due to vibration caused during a performance.

(2) The washer 16 with rubber includes the elastic body 15 made of rubber and the cylindrical portion 14*b*, which covers the outer circumference of the elastic body 15. Therefore, while being prevented from deforming outward by the abutment against the inner surface of the cylindrical portion 14*b*, the elastic body 15 deforms inward thereby tightening the lug bolt 9. Therefore, strong frictional force acts between the elastic body 15 and the lug bolt 9, and the lug bolt 9 is further prevented from loosening.

(3) The drum 1 includes the deformation restricting member, that is, the cover 14 for maintaining the axial deformation length of the elastic body 15 to be constant. The deformation restricting member forms the space S between the lower end of the cylindrical portion 14*b* and the upper surface of the upper hoop 6 when the elastic body 15 is not axially deformed. Therefore, when the lug bolt 9 is threaded into the lug nut 8, the elastic body 15 is prevented from being excessively deformed. Thus, the life of the elastic body 15 is easily extended.

(4) Since the inner diameter of the elastic body 15 before being attached to the lug bolt 9 is slightly smaller than the outer diameter of the lug bolt 9, the elastic body 15 applies inward force to the lug bolt 9 when being attached to the lug bolt 9. Therefore, when the lug bolt 9 is detached from the drum 1, the washer 16 with rubber does not fall off the lug bolt 9. Therefore, the possibility of losing the washer 16 with rubber is reduced.

It should be apparent to those skilled in the art that the present invention may be embodied in many other specific forms without departing from the spirit or scope of the invention. Particularly, it should be understood that the invention may be embodied in the following forms.

Figure 5:
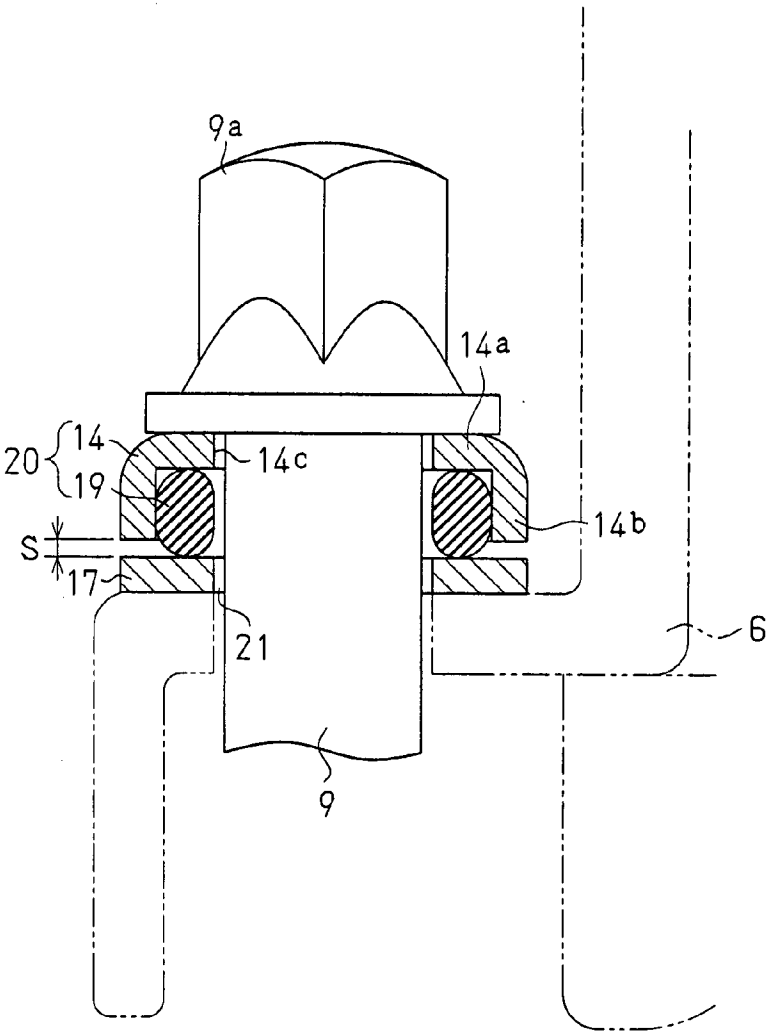
FIG. 5 is a side view illustrating the vicinity of the head of the lug bolt according to a modified embodiment.

As shown in FIG. 5, a flat washer 17 having a smooth surface may be located below a washer 20 with rubber. With this structure, when rotating the lug bolt 9, the flat washer 17 reduces frictional resistance between the elastic body 15 and the upper hoop 6. Therefore, the drum 1 is tuned up easily. This also prevents wear and damage of the elastic body 15 due to friction. The flat washer 17 may be made of either metal or resin. When the flat washer 17 made of metal is used, the flat washer 17 may be secured to the elastic body 15 by, for example, baking. In this case, the washer 20 with rubber and the flat washer 17 are integrated and will not be scattered when removing the lug bolt 9 from the drum 1.

When using the flat washer 17 made of resin, ribs 21 (see FIG. 5), which extend inward from the inner circumferential rim of the flat washer 17, may be provided. For example, the ribs 21 are formed at equal angular intervals along the inner circumferential rim of the flat washer 17. The ribs 21 are formed such that an imaginary circle that passes through the distal ends of the ribs 21 has an inner diameter that is slightly smaller than the outer diameter of the lug bolt 9. With this structure, the ribs 21 of the flat washer 17 made of resin tighten the lug bolt 9. Therefore, when the lug bolt 9 is removed from the drum 1, the flat washer 17 is prevented from falling off the lug bolt 9.

As shown in FIG. 5, the inner diameter of the elastic body 19 before being attached to the lug bolt 9 may be the same as or slightly greater than the outer diameter of the lug bolt 9. In this case also, the vibration caused during a performance is absorbed by the elastic body 19. If the elastic body 19 and the flat washer 17 having the ribs 21 are attached to the lug bolt 9, even when the lug bolt 9 is detached from the drum 1, the washer 20 with rubber and the flat washer 17 are prevented from falling off the lug bolt 9.

When attaching the washer 16 with rubber to the drum 1, the washer 16 with rubber may be arranged such that the annular portion 14*a* contacts the upper hoop 6. In this case, advantages are provided that are the same as the preferred embodiment described above. The flat washer 17 may be located between the lower surface of the head 9*a* of the lug bolt 9 and the washer 16 with rubber.

The annular portion 14*a* of the cover 14 may be omitted. That is, the cover 14 may be formed with only the cylindrical portion 14*b*. In this case also, corresponding operation and advantages as the deformation restricting member are obtained in the same manner as the preferred embodiment described above.

A predetermined gap may be formed between the inner surface of the cylindrical portion 14*b* and the outer circumferential surface of the elastic body 15 within a range in which the lug bolt 9 is sufficiently prevented from loosening by vibration caused during a performance.

A spring washer or a conical disk spring may be used instead of the washer 16 with rubber.

The loosening prevention structure (the washer 16 with rubber) of the preferred embodiment may be applied to a head adjusting device that includes a tension pipe. The tension pipe is provided instead of the pair of lugs 7 located along the axial direction of the body 2. That is, the tension pipe is a cylinder having upper and lower openings and extends along the axial direction of the body 2 at a position separate from the outer circumference of the body 2. The upper and lower ends of the tension pipe are provided with a pair of nuts to be threaded on to the threaded portion 9*b* of the lug bolt 9 located at the upper end of the drum 1 and a threaded portion (not shown) of a lug bolt located at the lower end of the drum 1.

Therefore, the present examples and embodiments are to be considered as illustrative and not restrictive and the invention is not to be limited to the details given herein, but may be modified within the scope and equivalence of the appended claims.

What is claimed is:

1. A drum comprising:

a cylindrical body having an opening, an outer circumference, and axial direction;

a head, which covers the opening of the body, the head including a rim and an outer circumference;

a cylindrical head frame, which is fitted to the outer circumference of the body, the head frame retaining the rim of the head and being movable along the axial direction of the body;

a hoop provided at the outer circumference of the head, the hoop abutting against the head frame to press the head frame along the axial direction of the body so that tension is applied to the head, the hoop including a plurality of mounting holes;

a plurality of fasteners located at the outer circumference of the body, each fastener being located opposite to the hoop with the head frame located in between, and each fastener including a nut;

a plurality of coupling bolts, which extend along the axial direction of the body, each coupling bolt including a head, with the head located opposite to the nut of one of the fasteners with the hoop located in between, and each coupling bolt being inserted in one of the mounting holes and threaded to said nut so that the hoop is coupled to the fastener; and a plurality of loosening prevention structures, each loosening prevention structure being located between the head of one of the coupling bolts and the hoop, and including an annular elastic body through which said one of the coupling bolts is inserted and a deformation restricting member, which is discrete from the head of the one of the coupling bolts and is placed between a bottom surface of the head and the annular elastic body to restrict deformation of the elastic body along said axial direction, wherein each deformation restricting member includes an annular portion through which the one of the coupling bolts is inserted and a cylindrical portion extending from the annular portion towards the hoop, wherein the cylindrical portion has an inner surface positioned adjacently to an outer circumference of the elastic body, and wherein the cylindrical portion is shorter in said axial direction than the elastic body along said axial direction, such that when the elastic body is not compressed along said axial direction, a space is formed between an end of the cylindrical portion and the hoop, and as the coupling bolt is tightened relative to the nut, the elastic body is compressed a length corresponding to and up to a length of the space in said axial direction and the cylindrical portion abuts against the hoop and the head of the bolt.

2. The drum according to claim 1, wherein the elastic body and the cylindrical portion are respectively so sized and shaped that the elastic body abuts against the inner surface of the cylindrical portion when each coupling bolt is threaded to the respective said nut.

3. The drum according to claim 1, wherein the cylindrical portion includes an opening, a first end, and a second end which is the end toward the hoop, and wherein each deformation restricting member further includes a ring, which decreases the opening of the cylindrical portion, and the ring is located at the first end of the cylindrical portion along said axial direction and includes a through hole through which said one of the coupling bolts is inserted.

4. The drum according to claim 1, wherein the elastic body is made of rubber.

5. The drum according to claim 4, wherein said one of the coupling bolts includes an outer diameter and the elastic body includes an inner diameter smaller than the outer diameter of the coupling bolt.

6. A drum comprising:

a cylindrical body having an opening, an outer circumference, and axial direction;

a head, which covers the opening of the body, the head including a rim and an outer circumference;

a cylindrical head frame, which is fitted to the outer circumference of the body, the head frame retaining the rim of the head and being movable along the axial direction of the body;

a hoop provided at the outer circumference of the head, the hoop abutting against the head frame to press the head frame along the axial direction of the body so that tension is applied to the head, the hoop including a plurality of mounting holes;

a plurality of fasteners located at the outer circumference of the body, each fastener being located opposite to the hoop with the head frame located in between, and each fastener including a nut;

a plurality of coupling bolts, which extend along the axial direction of the body, each coupling bolt including a head, with the head located opposite to the nut of one of the fasteners with the hoop located in between, and each coupling bolt being inserted in one of the mounting holes and threaded to said nut so that the hoop is coupled to the fastener; and a plurality of loosening prevention structures, each loosening prevention structure being located between the head of one of the coupling bolts and the hoop, and including an annular elastic body through which said one of the coupling bolts is inserted and a deformation restricting member, which is discrete from the head of the one of the coupling bolts and is placed between a bottom surface of the head and the annular elastic body to restrict deformation of the elastic body along said axial direction, wherein each deformation restricting member includes an annular portion through which the one of the coupling bolts is inserted and a cylindrical portion extending from the annular portion towards the hoop, wherein the cylindrical portion has an inner surface positioned adjacently to an outer circumference of the elastic body, wherein the cylindrical portion is shorter in said axial direction than the elastic body along said axial direction, and wherein each deformation restricting member further includes a flat washer located at the hoop and abutting against the elastic body, the flat washer facing an end of the cylindrical portion along said axial direction, and said one of the coupling bolts being inserted through the flat washer, such that when the elastic body is not compressed along the axial direction, a space is formed between the cylindrical portion and the washer, and as the coupling bolt is tightened relative to the nut, the elastic body is compressed a length corresponding to and up to a length of the space in said axial direction and the cylindrical portion abuts against the washer and the head of the bolt.

7. The drum according to claim 6, wherein the flat washer is made of metal and the elastic body is made of rubber, and the flat washer is heat-sealed to the elastic body.

8. The drum according to claim 6, wherein the flat washer is made of resin and includes a plurality of ribs, which extend inward from the inner rim of the flat washer.

9. The drum according to claim 8, wherein said one of the coupling bolts includes an outer diameter, and an imaginary circle passing through the distal ends of the ribs has an inner diameter smaller than the outer diameter of the coupling bolt.

* * * * *